US005853492A

United States Patent [19]

Cathey et al.

[11] Patent Number: 5,853,492

[45] Date of Patent: Dec. 29, 1998

[54] WET CHEMICAL EMITTER TIP TREATMENT

[75] Inventors: David A. Cathey; Terry Gilton, both of Boise, Id.

[73] Assignee: Micron Display Technology, Inc., Boise, Id.

[21] Appl. No.: 608,153

[22] Filed: Feb. 28, 1996

[51] Int. Cl.[6] ..... E03C 23/00

[52] U.S. Cl. ..... 134/3; 510/300; 510/330; 510/410; 510/728; 216/13; 216/103; 216/104; 216/108; 216/109

[58] Field of Search ..... 134/3; 510/300, 510/330, 410, 728; 216/13, 103, 104, 108, 109

[56] References Cited

U.S. PATENT DOCUMENTS 3,592,773 7/1971 Muller ..... 252/79.3

5,646,095 7/1997 Eidelloth et al. ..... 505/330

OTHER PUBLICATIONS

Cade et al. 1989, IEEE Transactions on Electron Devices, vol. 36 No. 11, pp. 2709–2714.

Spierings, 1993, J. Material Science, vol. 28, No. 3, pp. 6261–6273.

*Primary Examiner*—Marian C. Knode
*Assistant Examiner*—Ali R. Salimi
*Attorney, Agent, or Firm*—Hale and Dorr LLP

[57] ABSTRACT

A wet chemical process is provided for treating an emitter formed on a substrate of a field emission display, the process comprises applying a solution including hydrogen to the emitter. In one embodiment of the invention, the steps of applying a solution comprises applying a solution of hydrofluoric acid to the emitter.

19 Claims, 2 Drawing Sheets

WET CHEMICAL EMITTER TIP TREATMENT

BACKGROUND OF THE INVENTION

The present invention relates generally to electron generating devices including field emission displays, and more particularly, to a method for treating emitter tips to reduce their electron work function.

A device which utilizes field emission cathode tips to produce individual beams of current is described with respect to FIG. 1. FIG. 1 shows a plan view of the device having a substrate 100 with emitter tips 102*a*–102*n* formed thereon. The device also has a gate electrode 104 which is separated from the substrate 100 by an insulating layer 106. When a voltage 108 is applied between the gate electrode 104 and the substrate 100, an electric field is created which causes emitters 102*a*–102*n* to emit electrons 112 as shown. Electrons 112 then strike faceplate 110. Faceplate 110 typically has formed thereon a plurality of phosphor dots which are illuminated by the electrons 112.

Devices of the type just described are especially suitable for use in electronic applications requiring small, flat video displays such as lap top computers and video recorders. However, these types of devices are often battery operated. Therefore, it is important that the electronic components used in these devices, including the displays, consume as little power as possible in order to preserve battery life. This problem is especially compounded because it is generally desired that these devices are constructed to weigh as little as possible, and so, it is impractical to provide extended battery operation by using larger and heavier batteries. Therefore, it is important that any display designed for use with such devices consume as little power as possible.

With devices of the type described above, the amount of energy needed to cause the emitters 102*a*–102*n* to emit electrons 112 is known as the "work function" of the emitter. The greater the work function, the more energy required to cause the emitters to operate. Thus, it is desirable to create emitters having the lowest possible work function.

Previous attempts to create emitters having a low work function have not been completely satisfactory. For example, U.S. Pat. No. 5,089,292 (incorporated herein by reference) claims a method of coating the surfaces of an array of emitter tips with a layer of material, for example, cesium, which is said to reduce the electron work function of each of the emitter tips.

However, the above method does not recognize that the work function of the emitters is increased due to the formation of native oxides or other layers that are formed on the emitters during processing. Methods which attempt to reduce the work function of the emitter by coating it with another material simply coat over emitters having a high work function due to the problems described, and do not address the underlying problem. Accordingly, it is an object of the present invention to overcome the above-mentioned problems.

SUMMARY OF THE INVENTION

A wet chemical process is provided for treating an emitter formed on a substrate of a field emission display. In one embodiment, the process comprises applying a solution including hydrogen to the emitter. In another embodiment of the invention, the step of applying a solution comprises applying a solution of hydrofluoric acid to the emitter.

In a further embodiment, a process is provided in which the step of applying a solution of hydrofluoric acid comprises applying a solution of hydrofluoric acid which has been diluted with water such that the ratio of water to acid is about 500:1.

BRIEF DESCRIPTION OF THE DRAWINGS

For a more complete understanding of the invention and for further advantages thereof, reference is made to the following Detailed Description taken in conjunction with the accompanying drawings, in which.

It is to be noted, however, that the appended drawings illustrate only typical embodiments of this invention and are therefore not to be considered limiting of its scope, for the invention may admit to other equally effective embodiments.

DETAILED DESCRIPTION OF EMBODIMENTS OF THE INVENTION

Figure 1:
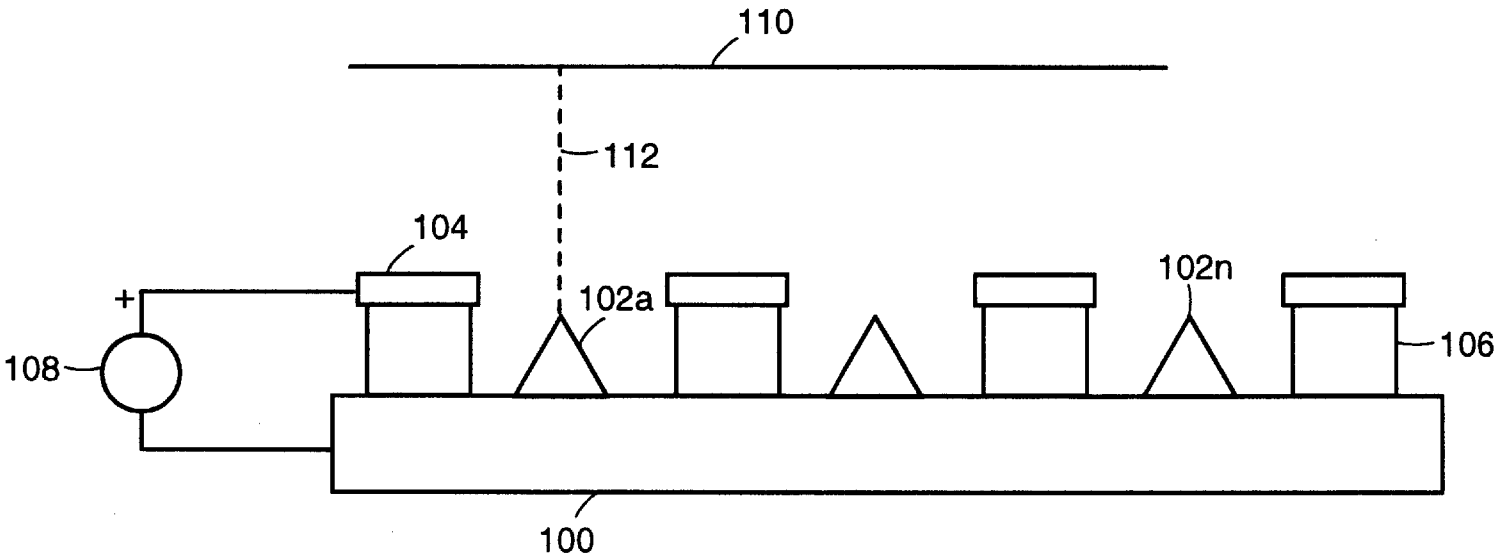
FIG. 1 is a planned view of a field emission display showing its operation.
Figure 2:
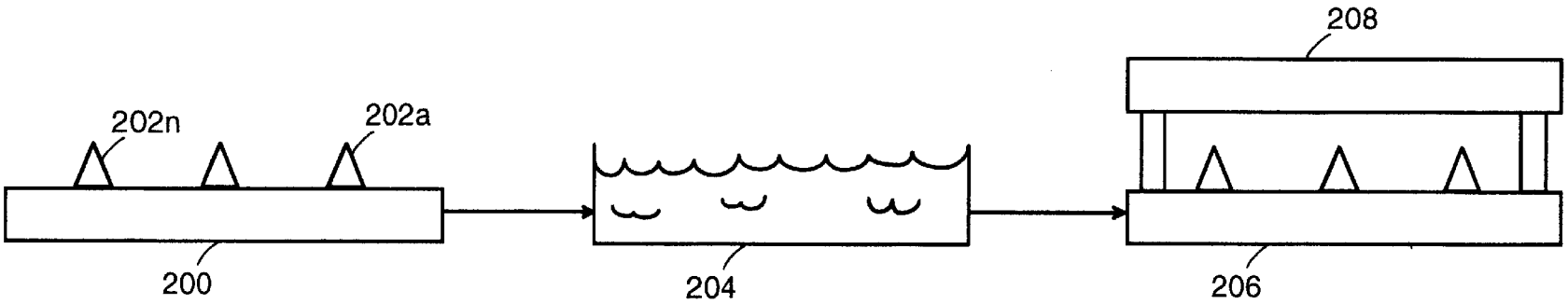
FIG. 2 is a diagram showing the processing steps for treating the emitter tips according to an embodiment of the invention.

Referring now to FIG. 2, a wet chemical process is provided for treating an emitter formed on a substrate of a field emission display. In one embodiment, the process comprises applying a solution 204 including hydrogen to the emitter 202*a*–202*n* formed on substrate 200. Hydrofluoric acid is an example of a solution known to be useful with the present invention.

In a more specific embodiment, the hydrofluoric acid is diluted with water such that the ratio of water to acid is between about 1:1 to about 1000:1. In one embodiment, the ratio of water to acid is about 500:1. Emitter tips 202*a*–202*n* are maintained in contact with the hydrofluoric acid until the native oxide layers are removed and emitter tips 202*a*–202*n* are "hydrogen terminated." As used herein, an emitter tip is said to be hydrogen terminated when the ratio of hydrogen ("H") to flourine ("F") on the surface is greater than 1.

Normally, whether acceptable hydrogen termination has occurred can be determined by reference to the length of time the hydrofluoric acid has been in contact with the emitters 202*a*–202*n*. For example, in one embodiment, the hydrofluoric acid, diluted to a ratio of 500:1 is maintained in contact with the emitters for a time period of between about 1 and about 10 minutes.

According to another embodiment, the hydrofluoric acid is applied at a temperature of between about 20° C. and about 25° C. Increasing the temperature of the application of the hydrofluoric acid will increase the speed at which the chemical reaction between the acid and the emitters takes place. For example, in one embodiment hydrofluoric acid of a 500:1 concentration is applied to the emitters at a temperature of 21.5° C. At this temperature, it is in contact with the emitters for a time period of about 10 and 30 minutes. If the temperature is increased to 30° C., the time period is decreased to between about 5 and about 15 minutes. The relationship between the temperature of the acid and the contact time period is determined by process considerations, though lower temperatures are preferred because at higher temperatures the HF may pit the substrate.

The above described process works particularly well with silicon emitter tips. For molybdenum tips, a slightly different embodiment of the invention is known to be useful. Of course, those of skill in the art will recognize that, although desirable results may be achieved by using any of the embodiments described herein with either silicon or molybdenum tips, the best results are achieved when a particular emitter material is matched to the most suitable treatment according to the present invention.

For molybdenum tips, an embodiment of the invention is used in which a solution of hydrochloric acid is applied to the emitters. In one aspect, the hydrochloric acid is diluted with water such that the ratio of water to acid is between about 10:1 to about 50:1. In one particular embodiment, the ratio of water to acids about 20:1. In another embodiment, the hydrochloric acid having a dilution ratio of about 50:1 is allowed to remain in contact with the emitter tip for about 10 minutes. In a further embodiment, the temperature is maintained at about 50° C.

According to another aspect of the invention, a solution of sulfuric acid is applied to the emitters. In one aspect, the sulfuric acid is diluted with water such that the ratio of water to acid is between about 10:1 to about 50:1. In one specific embodiment, the ratio of water to acid is about 20:1. In further embodiment, the sulfuric acid is applied to the emitters at a temperature between about 40° C. and about 60° C. In a still more specific embodiment, the sulfuric acid is applied at a temperature of about 50° C. At this temperature, the sulfuric acid is allowed to remain in contact with the emitters for between about 1 and about 5 minutes.

Those of skill in the art will recognize that additional hydrogen containing acids will also work in various embodiments of the invention. For example, other acids known to be useful in the present invention are hydrobromic, and hidrotic. Moreover, non-halogen containing acids such as phosphoric and acetic acid are also known to be useful in the present invention.

In addition to the above-described acids, embodiments using aqueous alkaline sulfates are also known to be useful in the present invention. For example, in one embodiment, the emitter tips are treated by applying a solution of ammonium sulphate.

In a specific example, the ammonium sulphate is diluted to between about 1 wt. % and 10 wt. %. In a particular embodiment, the ammonium sulphate is diluted to a water/sulphate ratio of about 5 wt. %.

According to a further embodiment of the invention, the sulphate is applied at a temperature of between about 20° C. and about 60° C., and allowed to remain in contact with the emitters for a time period of about 5 and 30 minutes.

In another embodiment, the invention comprises supplying a solution of ammonium hydroxide to the emitter tips. In one embodiment, the ammonium hydroxide is diluted with water such that the ratio of water to ammonium hydroxide is between about 1:1 and about 20:1. In a specific embodiment, the water to ammonium hydroxide ratio is about 10:1. At this concentration, the ammonium hydroxide is allowed to remain in contact with the emitter tips for a time period of between about 5 and 15 minutes.

Those of skill in the art will recognize that other aqueous alkaline sulfates, such as those of calcium, magnesium and potassium, are useful with the present invention.

After the emitters have been treated as described above, the work function will be reduced, and the substrate 200 is then sealed with faceplate 208 to form a complete field emission display having a lower work function and reduced burn time than field emission displays made without benefit of the present invention.

What is claimed is:

1. A wet chemical process for treating emitter tips formed on a substrate of an emitter for use in a field emission display, the process comprising applying a solution to the emitter tips to remove native oxides on the emitter tips.

2. A process as in claim 1 wherein applying a solution comprises applying a solution of hydrofluoric acid to the emitter tips.

3. A process as in claim 2 wherein applying a solution of hydrofluoric acid comprises applying a solution of hydrofluoric acid which has been diluted with water such that the ratio of water is acid is between about 500:1 and about 1:1.

4. A process as in claim 2 wherein applying comprises maintaining the hydrofluoric acid in contact with the emitter tips until all the native oxide is removed from the tips.

5. A process as in claim 2 wherein applying a solution comprises maintaining the hydrofluoric acid in contact with the emitter tips for a time period of between about 10 and about 15 minutes.

6. A process as in claim 2 wherein applying a solution comprises a solution of hydrofluoric acid at a temperature of between about 20° C. and about 25° C.

7. A process as in claim 1 wherein applying a solution comprises applying a solution of hydrochloric acid to the emitter tips.

8. A process as in claim 7 wherein applying a solution of hydrochloric acid comprises applying a solution of hydrochloric acid which has been diluted with water such that the ratio of water to acid is between about 20:1 and about 100:1.

9. A process as in claim 1 wherein applying a solution comprises applying a solution of sulfuric acid which as been diluted with water such that the ratio of water to acid to between about 20:1 and about 50:1.

10. A process as in claim 9 wherein applying a solution of sulfuric acid comprises applying the acid at a temperature of between about 50° C. and about 60° C.

11. A process as in claim 1 wherein applying a solution comprises applying an alkaline sulfate.

12. A process as in claim 11 wherein applying an alkaline sulfate comprises applying a solution of ammonium sulfate.

13. A process as in claim 1 wherein applying a solution comprises applying a solution of ammonium hydroxide which is diluted with water such that the ratio of water to hydroxide is between about 10:1 and about 100:1.

14. A process as in claim 1 wherein applying is performed for a sufficient time to remove all the native oxides from the emitter tips.

15. A process as in claim 14 wherein applying includes applying a solution of hydrofluoric acid.

16. A process as in claim 14 wherein applying includes applying a solution of hydrochloric acid.

17. A process as in claim 14 wherein applying includes applying a solution of ammonium sulfate.

18. A process as in claim 14 wherein applying includes applying a solution of ammonium hydroxide.

19. A process as in claim 14 wherein applying includes applying a solution of sulfuric acid.

* * * * *